US005848454A

United States Patent [19]

Kojima

[11] Patent Number: 5,848,454

[45] Date of Patent: Dec. 15, 1998

[54] STRAPPING SYSTEM AND FASTENER THEREFOR

[76] Inventor: Kimberly Kojima, 2167 Green River Rd., Williamstown, Mass. 01267

[21] Appl. No.: 747,236

[22] Filed: Nov. 12, 1996

[51] Int. Cl.[6] ..... A44B 11/00

[52] U.S. Cl. ..... 24/200; 24/693; 24/265 BC; 24/169

[58] Field of Search ..... 24/200, 198, 197, 24/169, 308

[56] References Cited

U.S. PATENT DOCUMENTS

| | | | |
|---|---|---|---|
| 153,469 | 7/1874 | Wright | 24/198 X |
| 157,772 | 12/1874 | Tyson | 24/169 X |
| 214,935 | 4/1879 | Mann | 24/169 X |
| 3,192,587 | 7/1965 | White | 24/200 |
| 4,197,620 | 4/1980 | Heuchert | 24/274 R |
| 4,262,406 | 4/1981 | Fredrickson et al. | 24/200 X |
| 4,482,319 | 11/1984 | Patch | 24/200 X |
| 5,245,731 | 9/1993 | Funathu | 24/200 |
| 5,479,797 | 1/1996 | Peterson | 24/16 PB X |

FOREIGN PATENT DOCUMENTS

| | | | |
|---|---|---|---|
| 515124 | 5/1921 | France | 24/200 |
| 917070 | 12/1946 | France | 24/200 |
| 881632 | 7/1953 | Germany | 24/200 |
| 25155 | 7/1908 | Sweden | 24/169 |
| 272701 | 6/1927 | United Kingdom | 24/200 |

*Primary Examiner*—Jose V. Chen
*Assistant Examiner*—Hanh V. Tran

[57] ABSTRACT

A strapping system using a novel buckle wherein one end portion of the buckle is attached to one end of a flat non-metallic strap, and the other end of the strap is threaded though the buckle in such a manner that the strap is held securely in place, and wherein the buckle is of a unitary structure comprising the attaching end portion and the threaded end portion in which are located two outer parallel legs and a center leg with two slots respectively therebetween, and with the walls of the slot closest to the attaching end being generally parallel to each other and positioned at an angle of between 45° and up to less than 90° as measured from the top or bottom surface of the buckle depending on the orientation of the walls of the slot. In another embodiment, instead of the strap being attached to the one end of the buckle, two sets of slots are formed by two sets of parallel outer legs and and other center leg, whereby both ends of the strap are threaded through respective slots in the two ends of the buckle.

11 Claims, 3 Drawing Sheets

FIG. 1
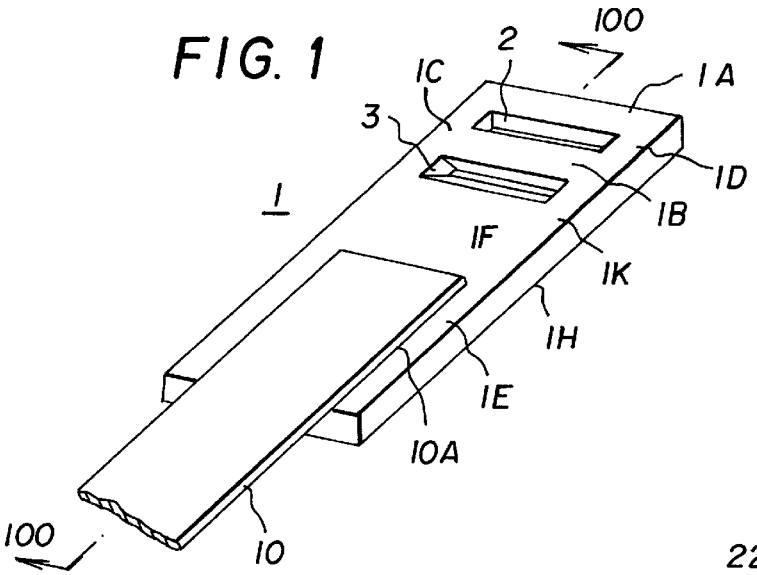
FIG. 8
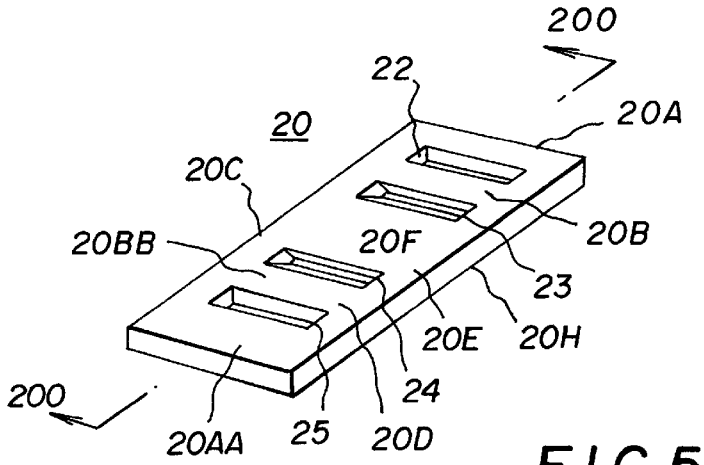
FIG. 2
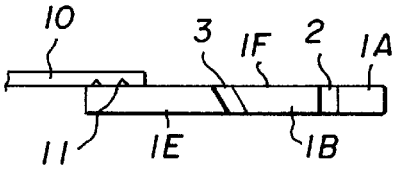
FIG. 5
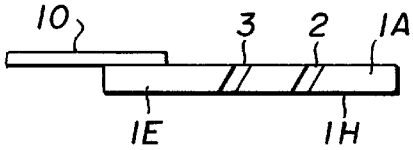
FIG. 3
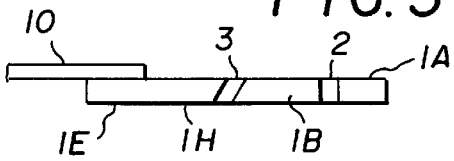
FIG. 6
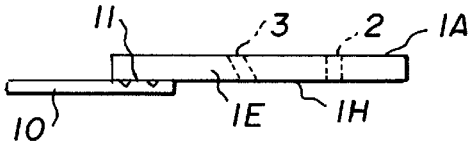
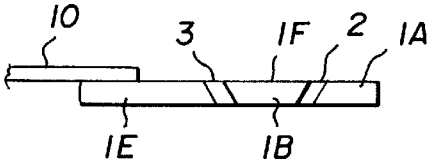
FIG. 4
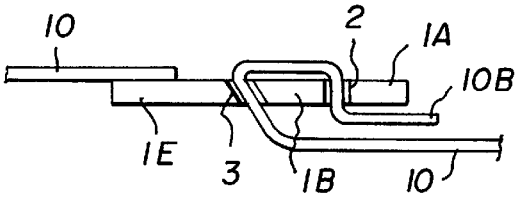
FIG. 7

STRAPPING SYSTEM AND FASTENER THEREFOR

BACKGROUND OF THE INVENTION

1. Field of Invention

This invention relates to a strapping system, and more particularly, to an improved buckle or fastener used therefor.

2. Discussion of the Prior Art

A conventional strapping system for tying an object may comprise a flat non-metallic strap which is placed around a package being secured and then overlapped at its ends and sealed together using, heat, ultrasound, or adhesive,etc.

The prior art contains many different types of buckles or fasteners for holding together the ends of a strap. The following is a list of known art: U.S. Pat. Nos. 3,967,347; 2,977,655; 4,299,014; 5,027,479; 5,426,829; 1,836,923; 1,519,708; 4,571,783; 5,426,829; 2,293,562; 2,407,466; 3,858,279; 4,525,901; 2,058,931; French Patent 867,048; and German Patent 2,612,033.

Despite these known devices, there is a continuing search for an improved buckle or fastener which can be used to fasten together a non-metallic strap and hold securely a package, and which can also be more simply and economically manufactured, and have good reliability.

SUMMARY OF THE INVENTION

Accordingly, an object of the invention is to overcome the aforementioned and other deficiencies and disadvantages of the prior art.

Another object is to provide a buckle which is of unitary structure, simple, reliable in operation, easy to thread with a strap, and is inexpensive to manufacture.

Another object is to provide a buckle which is of unitary structure, and to which a strap can be attached, and another to which the strap is not attached.

BRIEF DESCRIPTION OF THE DRAWINGS

FIG. 1 is a perspective view depicting a first illustrative embodiment of the invention.

FIGS. 2–5 are side elevational views taken along section line 100—100 of the embodiment of FIG. 1, depicting different angular slots formed in the buckle.

FIG. 6 is a view similar to FIG. 2 depicting an alternative placement of the strap attached to the buckle of FIG. 1.

FIG. 7 is a view similar to FIG. 2 depicting the threading of the strap through the slots of the buckle.

FIG. 8 is a perspective view depicting a second illustrative embodiment of the invention.

DETAILED DESCRIPTION OF THE PREFERRED EMBODIMENTS

Figure 11:
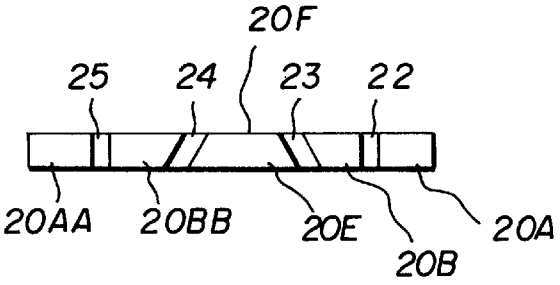
FIGS. 9–12 are side elevational views taken along section line 200—200 of the embodiment of FIG. 8, depicting different angular slots formed in the buckle.

FIGS. 1–7 show a buckle 1 to which is attached, such as by heat sealing, welding, glueing, etc, one end 10A of a non-metallic (e.g. plastic) strap 10, the other end 10B of strap 10 being threaded through buckle 1, as shown in FIG. 7, to securely tie and hold strap 10, for example, about a box.

The buckle 1, which may be formed for example of plastic, hard rubber, etc, is of a unitary structure, such as formed by extrusion, injection molding, stamping, etc, comprises an attaching portion 1E, and a threading portion 1K, which comprises a pair of parallel legs 1C,1D and perpendicular thereto parallel transverse legs 1A,1B, 1E with a pair of slots or openings 2,3 formed therebetween. In the following description, reference may be made to the various legs as being a center leg, and outer legs,etc, depending on the context of the description.

The attaching portion 1E may be narrower than the threading portion, or be of the same width as shown in FIGS. 1,8.

The top surface and bottom surface of buckle 1 are substantially flat and planar. Thus, advantageously, the buckle 1 and 20 (buckle is numbered differently in FIGS. 1 and 8) can be readily formed of a flat piece of material by simple stamping operation or by simple extrusion process.

As shown in FIG. 1, the strap end 10A may be attached to attaching end 1E by means of, for example, heat sealing or welding, glueing using an appropriate sealant,sonic bonding,etc. When heat sealing or welding or sonic bonding, one or more ridges 11 are formed in the attaching end to or bottom surface as desired. The ridges, welding bead, sealant, etc, are shown symbollically as number 11, in FIGS. 1 and 6. As stated, the strap 10 may be attached to the attaching portion 1E on the top surface (see FIGS. 1–5,7) or the bottom surface (see FIG. 6) of buckle 1, as desired.

The legs 1A,1B,1F,1C,1D are shown in the embodiments of FIGS. 1–17 to be preferably of the same vertical dimension (i.e. same thickness) to simplify the molding or other producing process. Similarly, the buckles 1 and 20 are shown to have a rectangular shape. Such rectangular shape simplifies molding and similar producing process. However, other shapes can be employed. Advantageously, however, the buckle is of unitary structure. Thus, economical manufacturing techniques are employed, and also, the buckle is simple in design, more reliable, more accurate, and considerably more economical to produce. Also, the buckle is such as to enable rapid, and easy manual threading of a strap through the slots thereof. Accordingly, the invention is of considerable commercial value and has advanced the art to a substantial degree.

Turning next to the main feature of the invention, which enables the buckle to be simple, efficient, reliable, and inexpensive, is the angular orientation of the walls of the slots 2 and 3.

Figure 13:
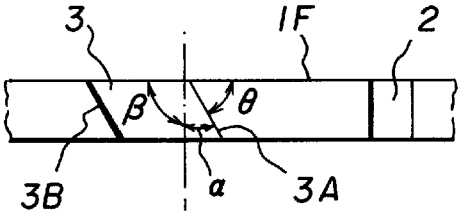
FIG. 13 is an elevational side view of the right end of the buckle of FIG. 2 showing details of the angular position of the walls of a slot of the buckle.
Figure 14:
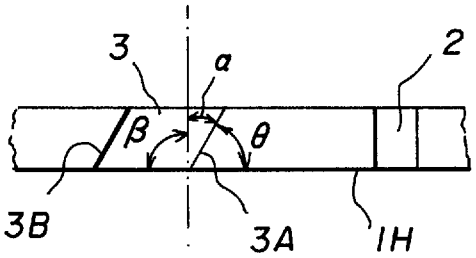
FIG. 14 is an elevational side view of the right end of the buckle of FIG. 3 showing details of the angular position of the walls of a slot of the buckle.

As shown in FIGS. 2 and 3, the slot 3 which is located farthest from the threading end of the buckle (and in the drawing located to be the left most of the two slots 2,3), that is closest to the end 1E to which the strap end 10A is attached has substantially parallel walls (e.g. shown as walls 3A and 3B in FIGS. 13,14) which are at an angle of between 45° and up to less than 90°, as measured from the top surface 1F of buckle 1 (see FIG. 13), or as measured from the bottom surface 1H of buckle 1 (see FIG. 14).

As shown in FIG. 13 (which is an enlarged view of the right side of FIG. 2) angle θ, which is measured from the top surface 1F, is the angle which the wall 3A makes with the flat top surface 1F, with angle Beta being 90° from the flat top surface 1F, and with angle Alpha being the remaining angle. Wall 3B is generally parallel with wall 3A of slot 3.

As shown in FIG. 14 (which is an enlarged view of the right side of FIG. 3) angle θ, which is measured from the bottom surface 1H, is the angle which the wall 3A makes with the bottom flat surface 1H, with angle Beta being 90° from the flat bottom surface 1H, and with angle Alpha being the remaining angle. Wall 3B is generally parallel with wall 3A of slot 3.

In considering the range of angles of between 45° and up to less than 90°, use of less than 45° weakens the angled corner so that pressure exerted by the strap in the locked position may break the angled corner and thus release the strap 10 from the locked position. Also, use of 90° or more reduces the locking effect of the angled corner.

The angular corner formed by wall 3A with the top or bottom surface of the buckle provides a locking arrangement when the other end 10B of strap 10 is threaded therethrough as shown in FIG. 7. In FIG. 7, the angled corner is disposed at the top surface. In FIG. 3, the angled corner is disposed at the bottom surface. As can be appreciated from viewing FIG. 7, the other end 10B of strap 10 is threaded from the bottom of slot 3, through slot 3, then over leg 1B, and then from the top of slot 2 toward the bottom thereof, and then between the strap 10 and the bottom surface 1H of buckle 10. The strap 10 is first threaded through slot 3 and manually tightened, then, strap 10 is threaded through slot 2, and the pulled through slot 2, and tightened again. The buckle 1, with the strap 10 threaded therethrough, will lie substantially flat on a package being tied, and any force exerted by strap, such as by an upward pull on the strap 10, the angled corner will bite into the strap 10 to lock strap 10 into position so that it will not slip.

Advantageously, hole 2 need only provide a mechanism for holding down strap 10, and need not provide any locking since the angled corner of slot 3 provides sufficient locking force. Thus, slot 2 can be perpendicular to the flat top or bottom surface, such as shown in FIGS. 2, and 3.

Also, advantageously, the angled corner can be either at the top of slot 3 (as in FIGS. 2,4,6,7) or at the bottom of slot 3 (as in FIGS. 3 and 5). The slot 3 must be the one located farthest from the end from which direction the strap is to be held, such as shown on the left in FIGS. 1–7). That is to say, the locking slot is farthest from the direction from which the strap 10 comes, and another slot 2 may be used to hold down the locked strap.

In such a case, the slot 2 may comprises walls which are perpendicular to the top surface 1F and bottom surface 1H of buckle 1. Greater locking effect can be also obtained by using such slot 2 having walls which have similar angled corners as the angled corners provided by slot 3. Such angled corners of slot 2 are shown in FIGS. 4 and 5, and are combined with the angled corners of slot 3. In FIGS. 4 and 5, wherein both slots 2 and 3 have walls which have similar angled corners, the descriptions of FIGS. 13 and 14 are also equally applicable. That is, description of the angled corner of wall 3A shown in FIGS. 13,14 is the same as for angled corners of walls 2A of slot 2 in FIGS. 4 and 5.

Returning again to the slots 2 and 3, the widths of the slots substantially match the width of the strap 10, and the thickness of the slots substantially match the thickness of the strap 10 so that a tight fit is accommodated with ease of threading. The width of the slots as a proportion of the width of the entire buckle would depend on the material used, and the thickness of the buckle produced. The legs 1D and 1C can be larger or smaller vis-a-vis the width of the slots depending on the strength and rigidity of the material used. For example, also, were the thickness of the buckle to be relatively thin, then legs 1C and 1D will be a larger proportion vis-a-vis the width of the slots. On the other hand, if the thickness of the buckle is greater, then the dimension of the legs 1D,1D vis-a-vis the width of the slots 2,3 will be smaller.

Also, advantageously, the buckle and strap can be of any desired size and width and thickness. For example the strap can be used to tie down a large pallet load, in which case the strap must be of a large width dimension and larger thickness (e.g. the width can be 3 inches) and the buckle 1 can be of a similar larger dimension (e.g. 4 inches in width with 3 inches of slot width). In contrast the strap may be small, such as ½inches wide, and the buckle may be similarly smaller in width, such as 1 inch wide with the slot width being ½inch wide. The thickness of the buckles would correspond to the width to provide the desired rigidity and strength.

Advantageously, because the strap may be made of plastic, that is be non-metallic, and the buckle also is made of plastic, that is be non-metallic, the strapping and buckle used to tie down the strapping can be used extensively for all different types of industrial and commercial use, as well as for consumer use. For example, the invention can be used to tie down fiber optics which require delicate tie down devices which can not harm the fibers. Also, advantageously, the invention can be used to substitute for rope where rope is now used, with the advantage of wide band safety in preventing the goods from being cut by the rope, and also with the advantage of convenience of not requiring knowledge of how to tie a knot.

Figure 12:
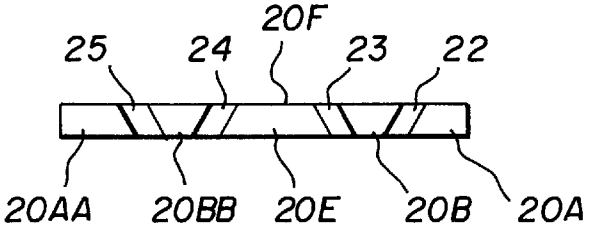
Figure 15:
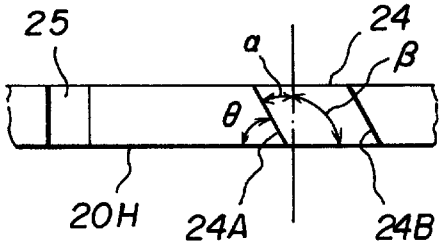
FIG. 15 is an elevational side view of the left end of the buckle of FIG. 9 showing details of the angular position of the walls of a slot of the buckle.
Figure 9:
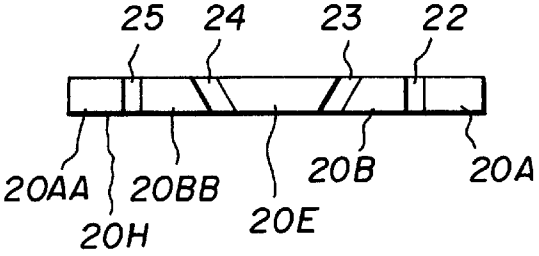
Figure 10:
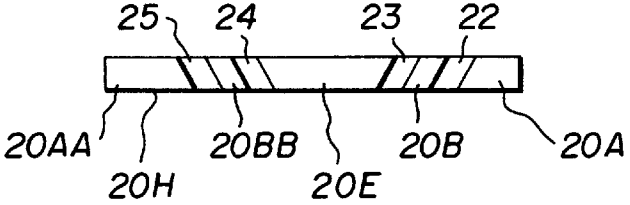
Figure 16:
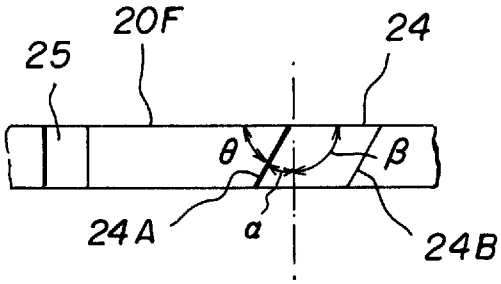
FIG. 16 an elevational side view of the left end of the buckle of FIG. 11 showing details of the angular position of the walls of a slot of the buckle.

In an alternative arrangement, the strap 10 is not attached to the buckle. Advantageously, in the alternative arrangement, the buckles can be stored separately, and the strap can be custom cut to size as needed. Such an alternative arrangement is shown in FIGS. 8–12, with a description of the angled corners of the relevant slots being shown in FIGS. 15 and 16. FIG. 8 is similar to FIG. 1 except that instead of strap 10 being attached to the buckle, a mirror image of slots 24 and 25 are provided to tie the otherwise attached end or strap 10. In a similar manner, FIG. 9 is similar to FIG. 3, FIG. 11 is similar to FIG. 2; FIG. 12 is similar to FIG. 4; FIG. 10 is similar to FIG. 5. FIG. 15 is similar to FIG. 14 in the description of the angled corner vis-a-vis the bottom surface; and FIG. 16 is similar to FIG. 13 in the description of the angled corner vis-a-vis the top surface.

As shown in FIG. 8, the strap 10 of FIG. 1 is not attached to buckle 20. Instead, a mirror image of slots 22,23 is provided, such mirror image of slots being 25 and 24. All of the descriptions relating to slots 2 and 3 (labeled 22,23 in FIGS. 8–12, 15,16) are applicable to the mirror image slots 25,24.

The mirror image slots 25,24 are used to lock one end 10A of strap 10, with the other slots 22,23 being used to lock the other end 10B of strap 10, in the same manner as explained with reference to FIG. 7.

Figure 17:
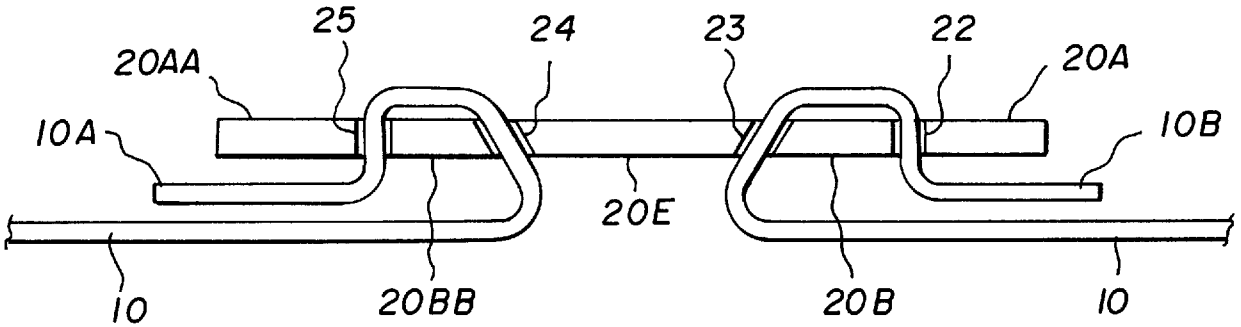
FIG. 17 is a view similar to FIG. 9 depicting the threading of both ends of the strap through the two pairs of slots of the buckle.

Thus, advantageously, for example, a trucker having a broken pallet can cut to size the strap 10, and using buckle 20 of FIG. 8, can thread one end 10A of strap 10 through the left side slots 24,25 as shown in FIG. 17, and lock the strap thereby. Then, he will thread the other end 10B of strap 10 through the right side slots 22,23, and lock the same, as shown in FIG. 17. Thus, advantageously, a plurality of buckles 20 can be independently and separately stored with a roll of strap, and a device for cutting the strap to size, and accordingly, have a simple, reliable and inexpensive mechanism for tying down packages that may have accidently broken apart.

As mentioned, the same description of the angled corners set forth with reference to FIGS. 13 and 14, are applicable to FIGS. 15 and 16, which describe the mirror image angled corners. FIG. 15 is an enlarged view of the left portion of FIG. 9, and FIG. 16 is an enlarged view of the left portion of FIG. 10.

Turning to FIG. 17, there is shown both ends 10A and 10B of strap 10 as threaded and locked in the two sets of slots 22,23 and 25,24. The threading procedure is the same as for FIG. 7 with the threading of the slots 24,25 on the left side being a mirror image of the threading on the slots 22,23 of the right side.

The foregoing description is illustrative of the principles of the invention. Numerous extensions and modifications thereof would be apparent to the worker skilled in the art. All such extensions and modifications are to be considered to be within the spirit and scope of the invention.

What is claimed is:

1. A rigid buckle made of plastic resin and formed as a unitary structure consisting of:

an end portion formed of a bottom surface and a top surface, one of which has permanently attached thereto a flat end surface of a non-metallic strap;

a main portion connected to said end portion and consisting of a rigid flat top surface and a rigid flat bottom surface, and therebetween two parallel outer parts and a parallel center part disposed between said two parallel outer parts and consisting of a pair of slots defined therebetween, one of said slots closest to said end portion consisting of a pair of side walls and a pair of parallel walls oriented at an angle of between 45° and up to less than 90° as measured from said top surface or said bottom surface of said main portion, wherein said flat surface of said end portion is co-extensive with one of said flat top surface and said flat bottom surface of said main portion so that said strap is threaded through said pair of slots and locked in a threaded position.

2. The buckle of claim 1, wherein the other of said slots consisting of walls oriented at an angle of between 45° and up to less than 90° as measured from a top surface of said main portion and at the wall farthest from the end portion.

3. The buckle of claim 1, wherein said slots have a width dimension along the parallel outer parts which substantially matches a width dimension of said strap, and a thickness dimension which substantially matches the thickness dimension of the strap.

4. The buckle of claim 1, wherein said bottom surface of said end portion has permanently attached thereto a flat end surface of said non-metallic strap.

5. The buckle of claim 1, wherein said top surface of said end portion has permanently attached thereto a flat end surface of said non-metallic strap.

6. The buckle of claim 1, wherein said strap is threaded through said pair of slots of said buckle as follows:

first, under a bottom surface of said parallel center part, then between said parallel center part and an outer parallel part, then above a top surface of said parallel center part, then between said parallel center part and the other outer parallel part, and in one of said pair of slots, and then below a bottom surface of the other outer parallel part, whereby the wall of said one slot having the angle of between 45° and up to less than 90° causes the strap to be held in a locked position.

7. A self-locking rigid buckle made of plastic resin and formed as a unitary structure consisting of:

two parallel outer portions, a plurality of parallel transverse portions connected perpendicular to said two parallel outer portions, and consisting of two outer slots and two inner slots formed between said two outer slots, wherein said two inner slots consist of a pair of outer walls and parallel walls oriented at an angle of between 45° and up to less than 90° as measured from a top surface or a bottom surface of said unitary structure, wherein said top surface and said bottom surface are flat and parallel to each other so that a non-metallic strap threaded through said slots are locked in a threaded position by said buckle.

8. The buckle of claim 7, wherein said two outer slots consisting of walls oriented at an angle of between 45° and up to less than 90° as measured from said top surface of said unitary structure and at the wall farthest from the ends thereof.

9. The buckle of claim 7, wherein said inner and outer slots have a width dimension substantially matching the width dimension of a strap, and a thickness dimension substantially matching the thickness dimension of said strap.

10. The buckle of claim 7, wherein said strap is threaded through said slots as follows: at one end of said buckle, first an end of said non-metallic strap is threaded through a bottom of an inner slot, through said inner slot, then above a transversed portion, then through an outer slot associated with that one end of said buckle, and then below one of said parallel outer portions located at said one end of said buckle; and then at the other end of said buckle, first the other end of said non-metallic strap is threaded through a bottom of the other inner slot, through said other inner slot, then above another transverse portion, then through the other outer slot associated with the other end of said buckle, and then below the other of said parallel outer portions located at said other end of said buckle, whereby the walls having the orientation of an angle between 45° and up to less than 90° securely locks the strap ends in a locked position.

11. A strapping system consisting of:

a flat non-metallic strap having two ends; and a rigid buckle made of plastic resin and formed as a unitary structure consisting of:

an end portion formed of a flat bottom surface and a flat top surface; wherein one end surface of said non-metallic strap is permanently attached to the flat bottom or top surface of said end portion; and a main portion connected to said end portion and consisting of a rigid flat top surface and a rigid flat bottom surface, and therebetween two parallel outer parts and a parallel center part disposed between said two parallel outer parts and consisting of a pair of slots defined therebetween, one of said slots closest to said end portion consisting of a pair of outer walls and a pair of parallel walls oriented at an angle of between 45° and up to less than 90° as measured from said top surface or said bottom surface of said main portion, wherein said flat top surface and said flat bottom surface of said end portion are co-extensive with said flat top surface and said flat bottom surface of said main portion so that another end of said strap is threaded through said pair of slots and locked in a threaded position by said buckle.

* * * * *